United States Patent [19]

Kilroy, Jr. et al.

[11] 4,027,424

[45] June 7, 1977

[54] MULTI-STRUCTURE ANIMATED AMUSEMENT DEVICE

[75] Inventors: Eugene Joseph Kilroy, Jr., Inglewood; Philip Warren Crain, Redondo Beach; James Frank Woods, Yettem, all of Calif.

[73] Assignee: Mattel, Inc., Hawthorne, Calif.

[22] Filed: Jan. 26, 1976

[21] Appl. No.: 652,003

[52] U.S. Cl. ..... 46/116; 46/1 C; 46/137; 46/119

[51] Int. Cl.[2] ..... A63H 13/04

[58] Field of Search ..... 46/1 C, 12, 116, 119, 46/137–140, 145, 148

[56] References Cited

UNITED STATES PATENTS

| | | | |
|---|---|---|---|
| 1,303,696 | 5/1919 | Mooradian | 46/148 |
| 1,533,543 | 4/1925 | D'Onofrio | 46/137 |
| 1,673,413 | 6/1928 | Marden | 46/19 |
| 2,419,872 | 4/1947 | Beder | 46/107 |
| 3,710,509 | 1/1973 | Spiegel | 46/202 |

*Primary Examiner*—Louis G. Mancene
*Assistant Examiner*—Robert F. Cutting
*Attorney, Agent, or Firm*—Max E. Shirk; Stephen L. King; John M. May

[57] ABSTRACT

An improvement is disclosed in those types of animated devices containing at least one animated toy figurine actuated by a plunger extending from the bottom of the figurine and a simulated structure, having a floor, such as a house, fire house, railroad station and the like, adapted to receive the figurine, and crank means associated with said structure for manually and remotely driving said figurine in which at least two crank means are associated with each simulated structure located at opposite ends of the structure and are operatively coupled together for joint movement, whereby operation of one of said crank means drives the other of said crank means as well as animating any figure properly placed within the structure, and in which each of the crank means includes means for coupling the crank means to a crank means of another structure of similar construction and purpose, whereby a plurality of crank means of a plurality of such structures may be coupled together for joint rotation and be driven through manual operation of a single crank means.

4 Claims, 7 Drawing Figures

MULTI-STRUCTURE ANIMATED AMUSEMENT DEVICE

FIELD OF THE INVENTION

This invention relates to animated toys and, more particularly, to an improvement in an animated amusement device of the type containing at least one simulated structure and in which a figurine disposed in the structure is remotely animated by means of a crank associated with the structure.

BACKGROUND OF THE INVENTION

Animated toys have provided movement and action which serves to engage, amuse, and delight very young children. One such toy to which particular reference is made is exemplified by U.S. Pat. Nos. 1,302,696 and 1,327,359 in which are shown prior art figurines, having movable arms which typically carries objects, such as hammers, and a pedestal or base through which a plunger or rod extends. In these devices the arm moves in response to reciprocation of the plunger which may be actuated by a crank.

Additionally, prior art toy building structures, simulations of actual homes, fire houses, stations and the like, have been connected together as shown in U.S. Pat. Nos. 1,673,413 and 3,577,672. With the structures shown in U.S. Pat. Nos. 1,302,696 and 1,327,359 the child may animate figurines in two buildings by operating the cranks with two hands. With present toys, prior to the invention, operating more than two cranks at one time appears impractical for the child.

OBJECTS OF THE INVENTION

An object of the invention, therefore, is to permit a child to animate the figurines disposed in a plurality of simulated structures simultaneously with only one hand.

It is a further object of the present invention to provide simulated housing structures of inexpensive and easy to assemble structure for use in combination with animated toy figures that may easily be arranged and rearranged into cities of two or more buildings and in which simultaneous animation of figurines disposed within each house is accomplished by the child with one hand.

SUMMARY OF THE INVENTION

In accordance with the foregoing objects, the invention is characterized by at least one simulated housing structure of the type having a plurality of recessed wells or cavities into which a figurine or figurines may be seated and in which the well bottom contains a small opening to receive a plunger mechanism of the figurine and in which a cam or the like means underlies each opening and is driven, such as by a rotatably mounted shaft, for reciprocating the plunger of the figurines, in which, by way of improvement, first and second cranks are provided located on opposite sides of the structure, and each crank includes a means for coupling to a crank associated with a second structure placed in proximity thereto. In the combination formed by two structures of similar construction the adjacent cranks of the two structures are coupled together for joint rotational movement and manual operation of the remaining crank on either one of said structures drives the crank of the other structure. A further aspect of the invention provides for all the cranks to be of identical geometry and shape. In such structure, each simulated structure may be coupled to another structure in either of two positions, 180° apart, to permit a variety of settings to be assembled by the child to prolong and retain the child's interest. In a more specific aspect, the crank comprises a wheel having a surface, an axis, a small cylindrical crank handle coupled to and projecting orthogonally from the surface of the crank wheel and located at a predetermined radial distance from the wheel axis, and an opening is provided in the surface of the wheel, located diametrically opposite the crank handle at the same radial distance from the wheel axis. The opening is of a size to receive a crank handle of identical shape and diameter as that attached to the crank wheel. Advantageously by broadly orienting the crank handles of adjacent structures and moving the houses together, the crank handles of opposed cranks fit within and engage the openings in the opposed crank wheels easily detachably coupling the cranks together for joint rotational movement.

The foregoing objects and advantages of the invention together with the structure characteristic of the invention and equivalents thereto is more readily understood by giving consideration to the detailed description of a preferred embodiment of the invention, which follows, and to the illustrations thereof presented in the drawings.

DETAILED DESCRIPTION

Figure 1:
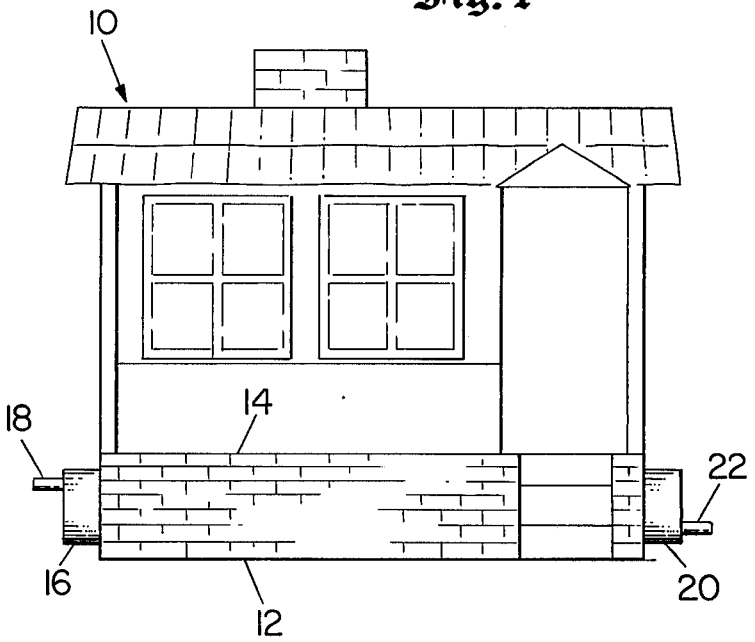
FIG. 1 is a front perspective view of a simulated structure that embodies the invention.

The building structure 10 illustrated in FIG. 1 is decorated to depict a railroad station and is exemplary of the other types of simulated buildings such as homes, fire stations, oil stations, and the like, which may be provided in accordance with the invention. Building 10 includes a foundation, generally indicated at 12, on four sides of the building, which supports a floor 14 above the surface on which the structure is placed. A first crank wheel 16, having an attached crank handle 18, is located on the left side of the building as viewed in the figure, and a second crank wheel 20, having an attached crank handle 22, is located on the right hand side of building structure. The crank wheels are of identical construction and are mounted to opposite ends of a shaft, not visible in this figure, for rotation about a common axis located a predetermined distance from the bottom of building foundation 12. The building structure is formed from any suitable material, preferably of plastic, as that term is understood generally.

Figure 2:
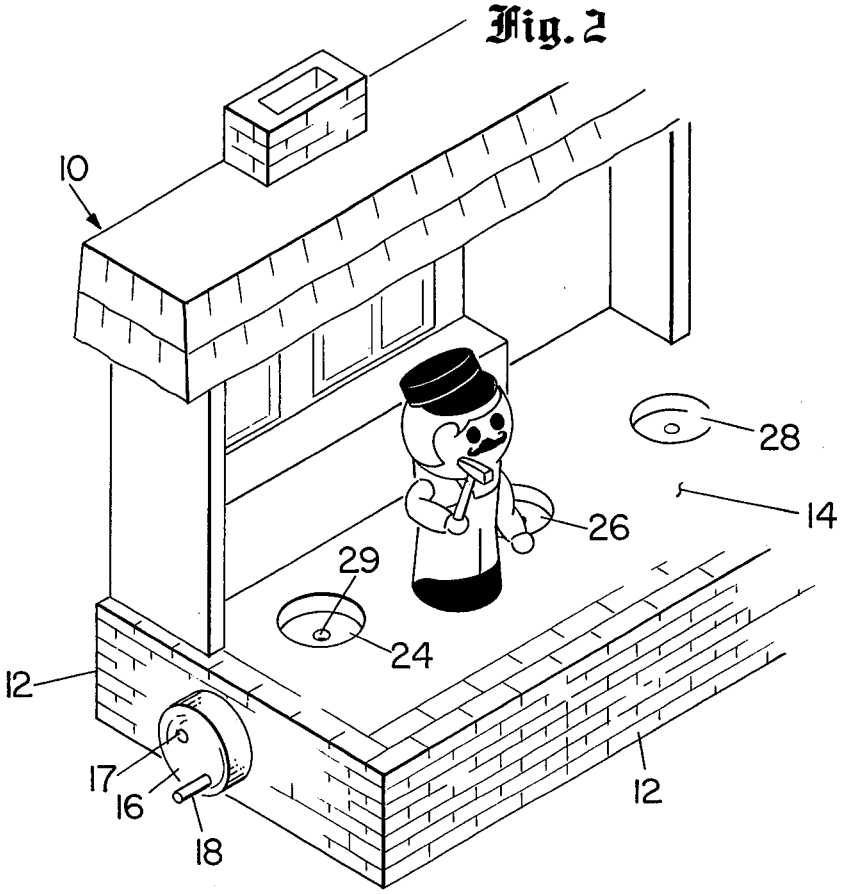
FIG. 2 is a perspective view of the structure of FIG. 1 taken from the upper left side.

FIG. 2 illustrates building structure 10 of FIG. 1 in perspective as viewed from the top and showing the front and left sides thereof. Accordingly, the same reference numerals used to identify the elements previously described in FIG. 1 are used to identify the elements in this and succeeding drawing figures. The side foundations 12, the floor 14, the crank wheel 16 and handle 18 which forms the left side crank means are visible. The floor contains three identical well-like cavities 24, 26 and 28, of a circular cross-section recessed into the floor. Each cavity contains a bottom surface and each bottom surface includes a small opening, such as 29 in cavity 24, centered therein, forming a passage to the space underlying the floor. As is more particularly described hereafter, each of the wells forms a seat within which to receive and seat a figurine. As viewed in FIG. 2, crank wheel 16 has an indentation in its surface and an opening 17, which is hereinafter more particularly described.

Figure 3:
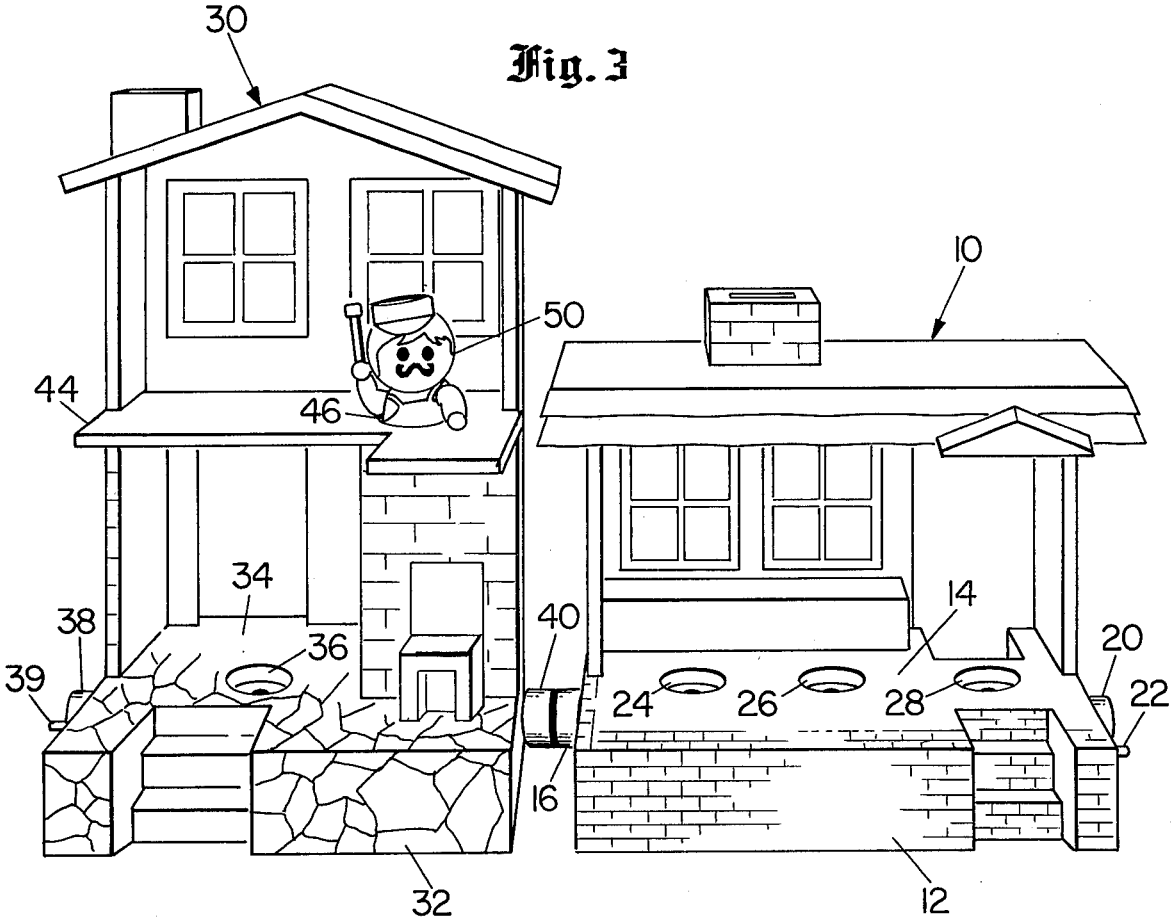
FIG. 3 illustrates a preferred embodiment of the combination invention.

Building structure 10 also appears in FIG. 3, to which reference is made. It is unnecessary to repeat the description of the various elements of building 10. A second building structure 30 is shown in combination with building 10 in FIG. 3. Building 30 is of a two-story construction and is decorated to depict a home. The building contains a side foundation 32 which supports a floor 34 and the floor contains a cavity or well 36 of generally cylindrical shape. The well has a small opening at the bottom, not visible in this figure, similar to the opening 29 illustrated in FIG. 2 in connection with building 10. Building 30 in this figure includes another floor 44 on the second story containing a well 46 of the same construction as that on the first floor level and a figurine 50 is shown seated in well 46. Preferably, the building is constructed of plastic material. A crank wheel 38 and its associated crank handle 39 is located to the left side of building 30 and a crank wheel 40 is located on the right side and is shown abutting crank wheel 16 of building 10 and, as hereinafter becomes apparent, the crank handle associated with crank wheels 40 and 16 are not visible in this figure. Building 30 thus contains two manual crank means located on opposite sides of the structure and are attached to opposite ends of a shaft, not visible, mounted under floor 34 for rotation about a common axis at a predetermined distance from the bottom of the foundation 32. And as is clear, the common axis of building 30 is in line with the common axis of crank wheels 16 and 20 associated with building 10. Crank wheels 16 and 20 are coupled together for joint rotation. Hence, if either crank handle 22 is operated to turn wheel 20 or crank handle 39 is operated to turn crank handle 38, all of the other crank wheels associated with the two buildings rotate concurrently. The animated toy figure 50 introduced in FIG. 3 is better illustrated in FIG. 4. This figurine is of the type containing a movable arm 52 holding a hammer and a plunger 54 which extends through the figurine base 56. Arm 52 is pivotably mounted and is connected within the structure to the plunger 54 by conventional means in such a manner that when the plunger 54 is pushed forward the arm raises to the elevated position generally indicated by the broken lines, and when the plunger is allowed to drop, the arm lowers. The figurine base 56 is circular and is of a diameter only slightly less than the diameter of the wells. This allows preferably frictional engagement between the walls of the well and the figurine base to firmly seat the figurine in the wells. This particular animated figurine and, more particularly, the detailed internal mechanism in which the figurine operates in the described manner is, of course, not necessary to an understanding of the present invention.

The base 36 of the figurine is of a circular shape and the seats or wells in the floor of the various buildings 10 and 30 is sufficient to frictionally engage the outer periphery of the base so as to lightly hold the structure in place within the well. It is noted that, as an alternative, the weight of the figurine torso may be made sufficiently heavy to retain the figure in place during operation of the plunger mechanism 54 or a more positive fastening means of conventional structure may be used.

Figure 5:
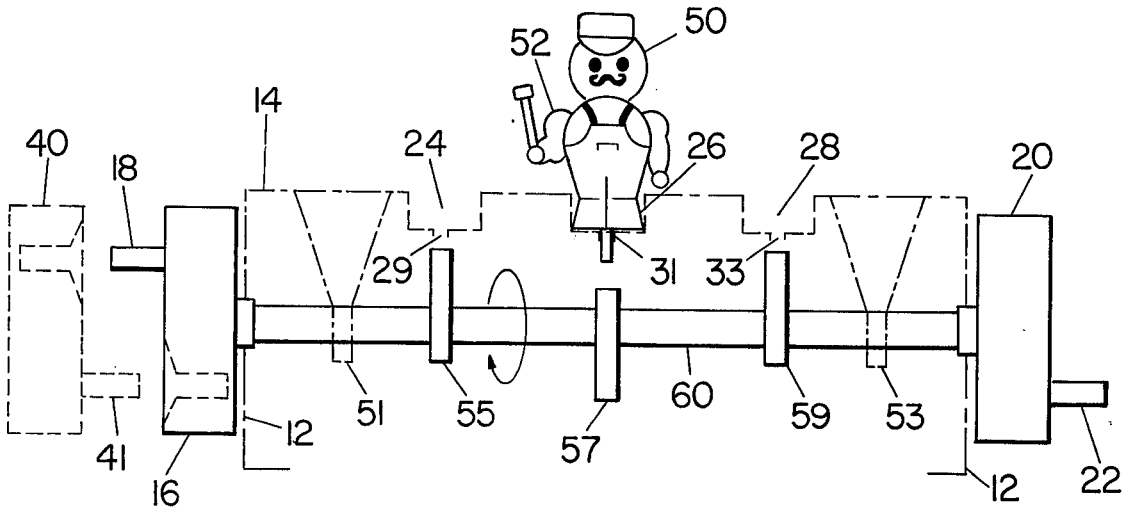
FIG. 5 illustrates a crank and a crankshaft used in the structure of FIG. 1 and additionally illustrates, schematically, the relationship thereof with respect to the other elements of the preferred embodiment.

Reference is now made to FIG. 5 showing, drawn to an enlarged scale, the simplified crank and cam shaft arrangement used, for example, in connection with the building of FIG. 1. Thus the crank wheel 16 and its handle 18 are illustrated as viewed from the building front. Similarly, crank wheel 20 and attached crank handle 22 located on the opposite side of the building is illustrated. Each of the crank wheels is attached to an end of a rotatably mounted shaft 60 mounted in any conventional manner, such as illustrated in dash lines, by the shaft support journals 51 and 53 and the shaft carries cam surfaces 55, 57 and 59. The shaft and cams are made of plastic material or any other suitable material. For clarity of understanding the embodiment, the foundation 12 of building 10 is schematically illustrated in FIG. 5 as is the floor 14 and each of the three wells or cavities 24, 26 and 28, the openings in the bottom of each of the wells 29, 31 and 33, respectively.

One cam is associated with each passage or opening and the cam surface forms an obstruction underlying the respective openings. Clearly, with rotation of the shaft as the cam lobe proceeds away from the opening, the obstructing cam surface is seen to move away from the opening to increase the spacing therebetween and, conversely, as the cam lobe reaches a peak near the opening the obstructing surface moves forward. This cam thus provides a reciprocal action as viewed through the passage. By engaging of the plunger of figurine 50, illustrated disposed in the well 26, the plunger reciprocates accordingly and in turn moves the arm of the figurine up and down. A crank wheel 40 of an adjacent building and the crank handle 41 are schematically illustrated with the wheel axis in line.

Figure 6:
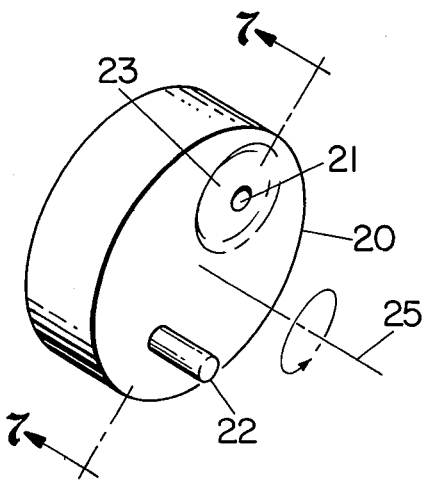
FIG. 6 illustrates in perspective a preferred embodiment of a novel crank.

The preferred form of a novel crank used in connection with the buildings of the previous figures is illustrated in perspective in FIG. 6. The crank includes the crank wheel 20 which has a central axis 25, a crank handle 22 which has the form of an elongated cylinder of small diameter attached in any conventional manner or integrally formed with the crank wheel 20. Located diametrically opposite the crank handle 22 is an opening 21. The opening 21 is sufficient in diameter to receive therewithin a crank handle of the geometry of crank handle 22 from another crank assembly. In effect, the opening 21 functions as a crank coupling or interlocking means. The opening 21 is located radially the same distance from the wheel axis as crank handle 22. Moreover, a portion of the surface of the crank wheel 20 is concavely tapered or recessed such as shown by walls 23 tapering to the entrance to hole 21. With this construction an identical crank oriented opposite to crank wheel 20 in this figure, such as occurs in the case of FIG. 3 where crank wheels 14 and 16 are in abutment, allows the crank handle of the second crank to fit and be received within opening 21 and a corresponding opening in the second crank wheel receives therewithin and couples crank handle 22 so that the two crank wheels are then interlocked for joint rotation about axis 25. Quite simply, the two cranks may be coupled or attached by essentially moving them together, and released or detached by pulling them apart essentially forming a releasible coupling.

Figure 7:
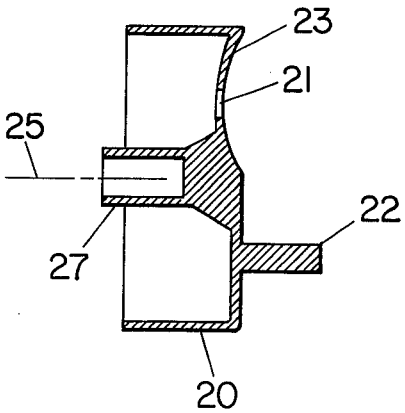
FIG. 7 is a section of the crank of FIG. 6 taken along line 7—7.

The crank wheel 20 is shown in section in FIG. 7 which section is taken along the line 7—7 in FIG. 6. There is thus shown the crank wheel 20 in handle 22, tapered surface 23, opening 21 and the axis 25. The sprocket 27 is formed of a hollowed out portion which may be integrally formed with the other portions of the crank and has a hollowed out portion large enough to receive the shaft 60 as previously described in connection with FIG. 5. A suitable plastic adhesive may be used to permanently join the elements.

Although we have not described in detail the shaft employed in the building 30 of FIG. 3, it is clear that it is essentially identical in all respects with one modification. Inasmuch as the building 30 contains a second story, a push rod must extend through from the second story to the area of the crank underlying the floor 34 for engagement with the cam so that the push rod so employed operates the plunger of the figurine 50.

Considering the previous description of the construction of the invention, it is quite apparent to the reader that the child can take a simulated building, such as of the type shown in FIGS. 1 and 2, and place it in juxtaposition with another building such as shown in FIG. 3 to orient the two crank wheels 40 and 16 of the adjacent buildings so the crank handles of opposed cranks are aligned essentially with the openings in the opposed cranks and then push the two structures together to couple the crank mechanisms of the two structures for concurrent shaft rotation. Inasmuch as the crank assemblies of all the buildings are identical, building 10 may be turned around by 180° so that its back is visible and similarly crank wheel 20 may be coupled to crank wheel 40 of building 30 so that a different setting is created.

Figure 4:
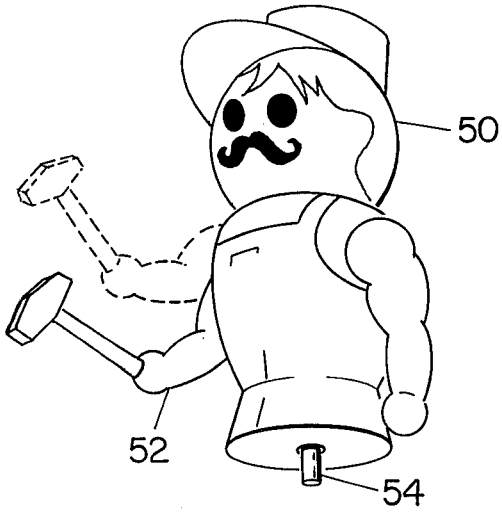
FIG. 4 illustrates an animated figurine used in the preferred operation of the invention.

With an animated figurine of the type shown in FIG. 4 disposed in the wells in each of the buildings 30 and 10 in FIG. 3, the child rotates crank handle 39 to rotate crank wheel 38 causing animation of the associated figure. This driving crank results in the crank wheel 40 being driven which in turn drives crank wheel 16 of building 10 and this in turn causes the reciprocal operation underlying the wells 24, 26 and 28 in building 10, and which may also animate a figurine disposed therein. Similarly, additional buildings of like structure and construction may be added serially along to form a string of three or four or more buildings so that the child can fill the buildings with figurines and operate one of the end cranks to thereby cause a considerable amount of action in various building settings. It is clear to accomplish the foregoing, the axis of the shafts and cranks must be located the same distance above the supporting surface from the bottom of the foundation. For convenience, inasmuch as all of the crank shafts are mounted to the floor, the floor of the buildings are necessarily the same height from the bottom of the foundation as in the other building, and the crank shafts mounted the same distance from the bottom of the floor surface shown in the figure.

It is believed that the foregoing description of the preferred embodiments of our invention is sufficient to enable one skilled in the art to make and use same. It is expressly understood, however, that our invention is not limited to the details presented for that purpose in the foregoing description, inasmuch as various modifications or substitution of equivalent elements suggest themselves to one skilled in the art upon reading this specification. Thus for example, while we have shown what we believe to be a novel and useful arrangement in a crank and the crank coupling means associated with each crank, it is conceivable that other specific types of crank wheels may be used to detachably and easily couple the rotating shafts of the separate buildings together. Accordingly it is respectfully requested that our invention be broadly construed within the full spirit and scope of the appended claims.

What is claimed is:

1. An animated amusement device comprising in combination:

at least a first and second simulted building structure, each of said simulated building structures having a floor;

a foundation for supporting said floor, and at least one cavity recessed in said floor adapted to receive the base of an animated figurine for seating an animated figurine, said cavity including a bottom surface and a small plunger-receiving opening in said bottom surface forming a passage to the space underlying said floor adapted to receive a plunger depending from the base of such animated figurine, each said structure further including a crankshaft located under said floor, said crankshaft containing a cam means located underlying said small passage in said cavity for engaging any plunger inserted through said passage;

a first and a second crank means of substantially identical structure, each of said crank means including a crank wheel having an axis of rotation, a crank handle of small cylindrical geometry coupled to and orthogonally projecting from said wheel at a predetermined radial distance from said wheel axis, and a crank handle-receiving opening located in said wheel diametrically opposite said crank handle and at the same radial distance from said wheel axis;

said first crank wheel located on one side of said simulated structure and operatively coupled to said crankshaft for joint rotational movement therewith and said second crankwheel located on the opposite side of said simulated structure and operatively coupled to said crankshaft for joint rotational movement therewith, said wheels being mounted for rotation about the wheel axis and with the wheel axis of each being located on a common axis located a predetermined distance above the bottom of said building foundation;

whereby each one of said crank means drives said cam means to reciprocate any plunger of a figurine protruding through said cavity opening and drives the other one of said crankwheels, and whereby, when said crank wheel of said one of said structures is coupled to the crank wheel of the other of said structures by engagement of the crank handles of one crank wheel into the crank handle-receiving means in the crank wheel of the adjoining simulted structure the cam means of said second simulated structure is simultaneously driven.

2. An animated amusement device which includes:

a simulated structure, said simulated structure having a floor;

a foundation supporting said floor;

at least one well-like cavity in said floor, each said cavity having a bottom with said bottom containing a small passage therethrough to a space underlying said floor, said cavity being adapted to receive the base of a figurine, having a plunger extending through the bottom of said base to protrude through said opening to the region underlying said floor;

first and second crank means of substantially identical structure located on opposite sides of said simulated structure;

a movable obstructing surface located underlying said small opening, said surface being movable to cyclically increase and decrease the spacing to said opening, and means responsive to driving rotation of either one of said crank means for moving said obstructing surface to cyclically vary the spacing between the small opening and for rotating the second one of said crank means;

whereby any figurine plunger protruding through said small opening in said cavity is reciprocated;

and means associated with each of said crank means for releasibly coupling each said crank means to the crank means of a second simulated structure having crank means of substantially identical structure and located on an axis common to that of said crank means for joint rotational movement.

3. The invention as defined in claim 2 wherein each said crank means comprises a wheel having a surface, a small cylindrically shaped handle coupled at an end to said surface of said wheel and protruding orthogonally therefrom, said handle located at a predetermined radial distance from the axis of said wheel, and an aperture in said wheel surface extending parallel to said wheel axis located diametrically opposite said handle and at the same radial distance from said axis, said opening being of a diameter slightly larger than said crank handle for receiving therewithin a crank handle.

4. The invention as defined in claim 3 wherein a portion of said surface of said wheel is concavely tapered to form a depression in said surface about said aperture and wherein said aperture is located within said concavely tapered surface portion.

* * * * *